US006015084A

United States Patent [19]

Mathieu et al.

[11] Patent Number: 6,015,084

[45] Date of Patent: Jan. 18, 2000

[54] SET OF BLANKS, BOX, METHOD AND MACHINE FOR MAKING A BOX FROM SAID SET OF BLANKS

[75] Inventors: Gérard Mathieu, Cergy; Didier Desertot, Dijon, both of France

[73] Assignee: OTOR, Paris, France

[21] Appl. No.: 09/117,348

[22] PCT Filed: Jan. 21, 1997

[86] PCT No.: PCT/FR97/00113

§ 371 Date: Jul. 21, 1998

§ 102(e) Date: Jul. 21, 1998

[87] PCT Pub. No.: WO97/27114

PCT Pub. Date: Jul. 31, 1997

[30] Foreign Application Priority Data

Jan. 22, 1996 [FR] France ..... 96 00677

[51] Int. Cl.[7] ..... B65D 5/54; B65D 5/56; B31B 7/00

[52] U.S. Cl. ..... 229/122.32; 53/207; 53/462; 229/125.04; 229/231; 229/930; 229/939; 493/94; 493/96; 493/907

[58] Field of Search ..... 493/93–96, 110, 493/175, 906, 907; 53/170, 172, 207, 449, 462; 229/122.32, 122.33, 125.04, 185.1, 231, 234, 930, 939

[56] References Cited

U.S. PATENT DOCUMENTS

| | | | |
|---|---|---|---|
| 1,784,317 | 12/1930 | Stokes | 53/462 |
| 1,912,698 | 6/1933 | Forsman | 229/939 |
| 2,330,294 | 9/1943 | Leavitt et al. | 229/122.32 |
| 2,776,608 | 1/1957 | Fischer et al. . | |
| 3,185,045 | 5/1965 | Bronte et al. | 493/110 |
| 3,291,372 | 12/1966 | Saidel | 229/122.32 |
| 3,361,326 | 1/1968 | Croley et al. | 229/122.33 |
| 3,986,319 | 10/1976 | Puskarz et al. | 53/207 |
| 4,177,936 | 12/1979 | Ford, Jr. et al. | 229/122.32 |
| 4,260,442 | 4/1981 | Ford et al. | 229/939 |
| 4,608,038 | 8/1986 | Virta et al. . | |
| 4,905,864 | 3/1990 | Balin | 229/939 |
| 5,108,028 | 4/1992 | Schillaci . | |
| 5,439,168 | 8/1995 | Kim | 229/930 |
| 5,551,938 | 9/1996 | Stone | 493/96 |

FOREIGN PATENT DOCUMENTS

| | | | |
|---|---|---|---|
| 1389146 | 1/1965 | France | 229/930 |
| 2 629 012 | 9/1989 | France . | |
| 2 665 137 | 1/1992 | France . | |
| 24 33 721 | 1/1976 | Germany . | |

*Primary Examiner*—Gary E. Elkins
*Attorney, Agent, or Firm*—Merchant & Gould P.C.

[57] ABSTRACT

A set of blanks, a box, a method and a machine for making a packaging box that includes at least two blanks made of a fiberboard or corrugated fiberboard sheet material, i.e. a first blank comprising a series of at least four flaps for forming the side walls of the box, and a second blank comprising at least two panels joined together along a third fold line. The second blank straddles at least one fold line of the first blank, the first panel is attached to and/or centred on the first blank, and at least one of the second panels is attached to the first blank via means that enable movement of the second panels relative to the first blank when the box is formed by simultaneously wrapping said blanks around a volume having a predetermined size.

42 Claims, 12 Drawing Sheets

Fig. 1
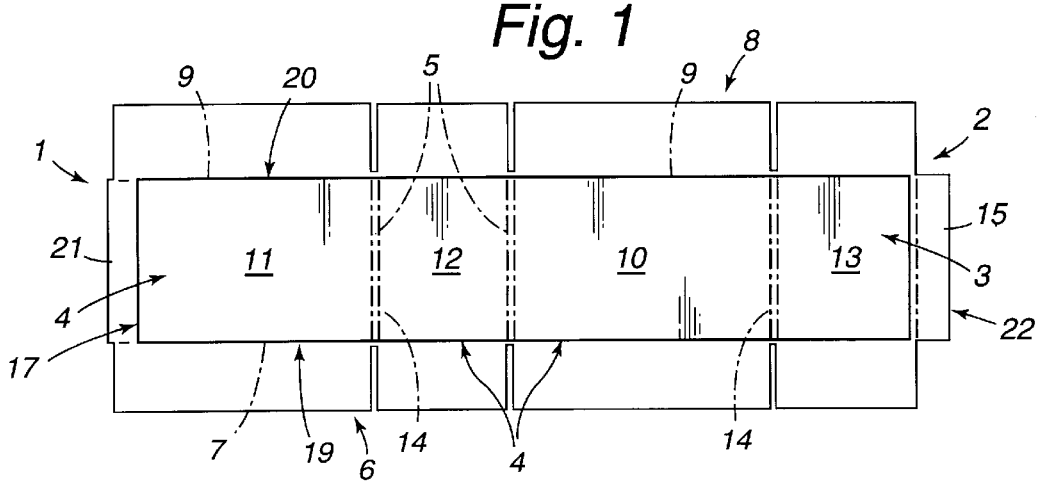
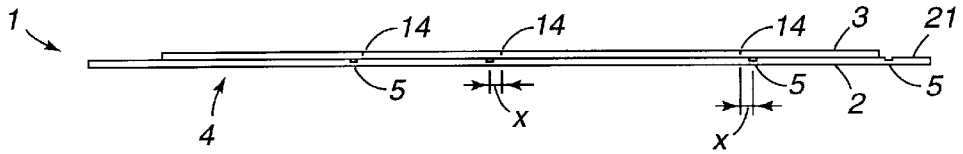
Fig. 1'
Fig. 2'
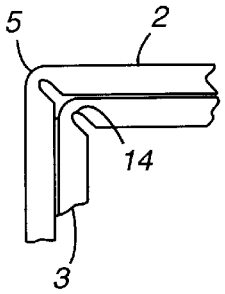
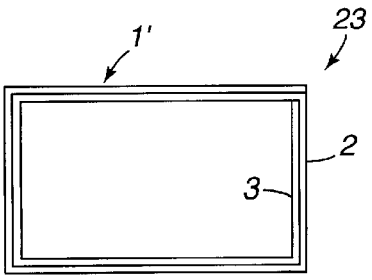
Fig. 2
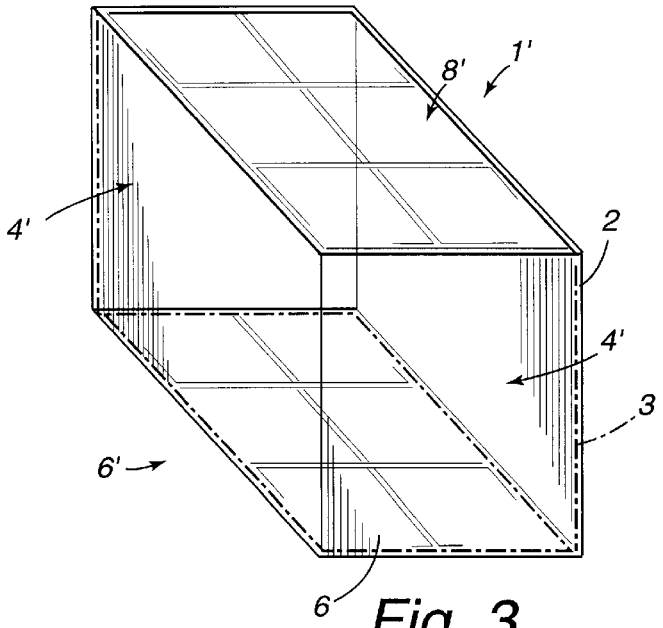
Fig. 3

Fig. 2A
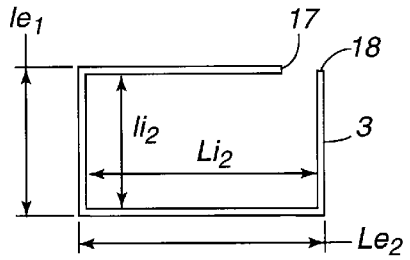
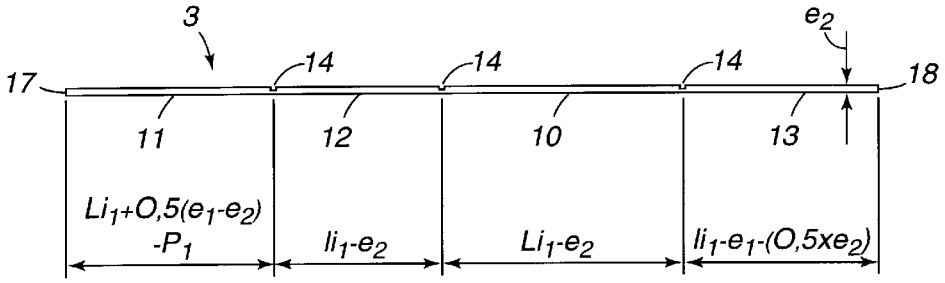
Fig. 2A'
Fig. 2B
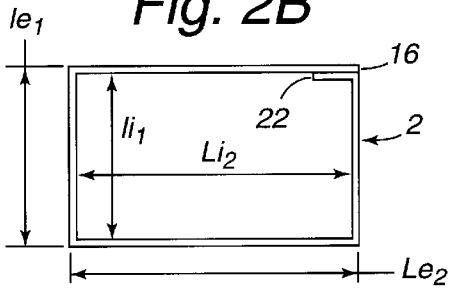
Fig. 2B'
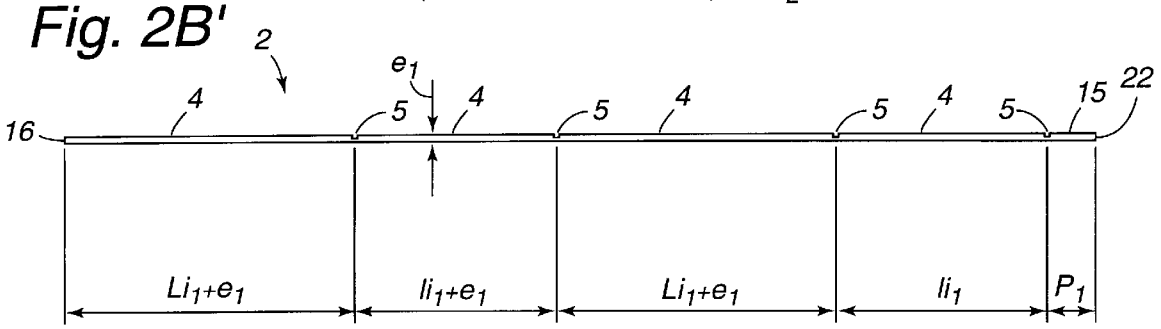

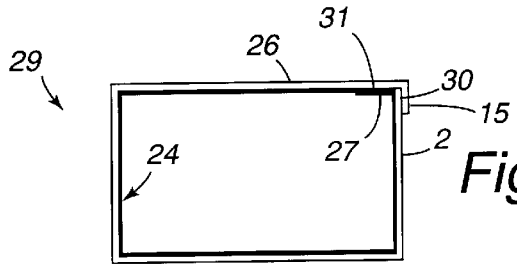
Fig. 5
Fig. 4
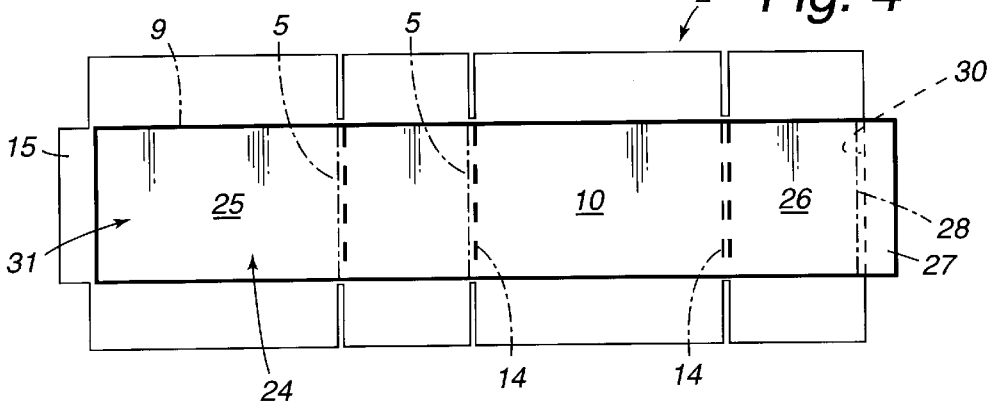
Fig. 7
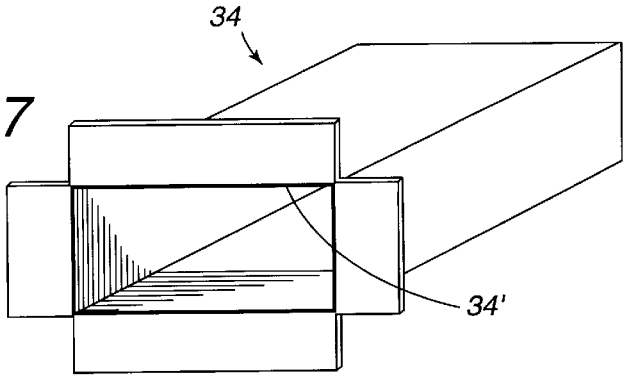
Fig. 6
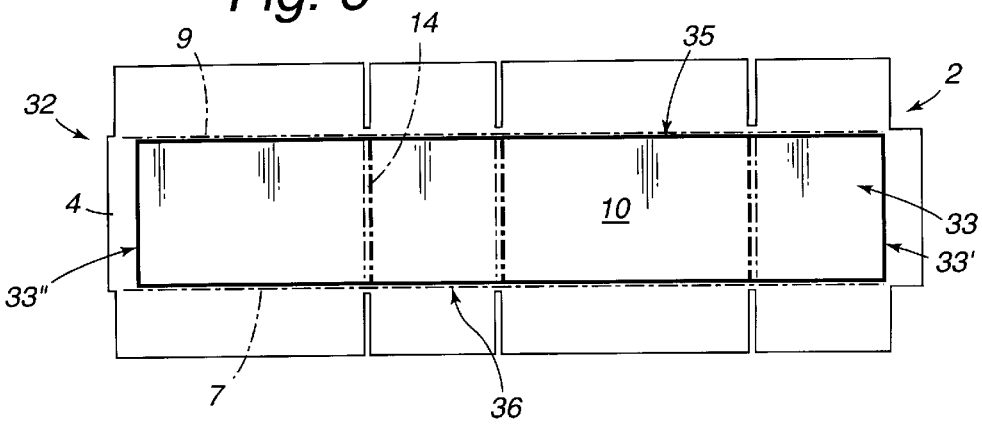

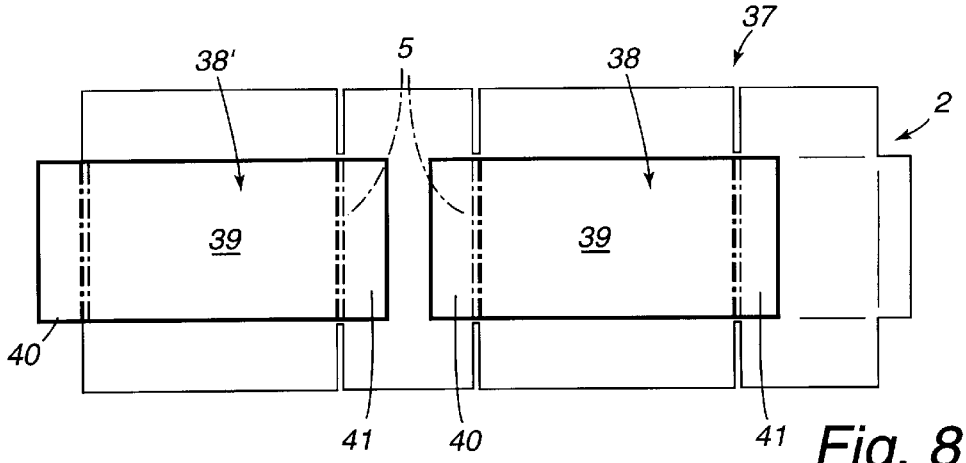
Fig. 8
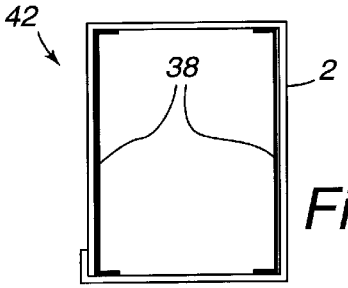
Fig. 9
Fig. 11
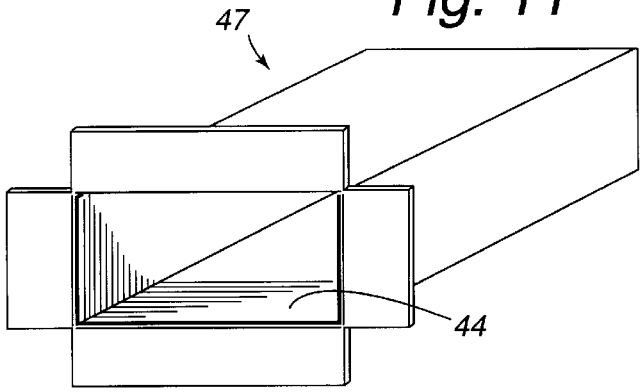
Fig. 10
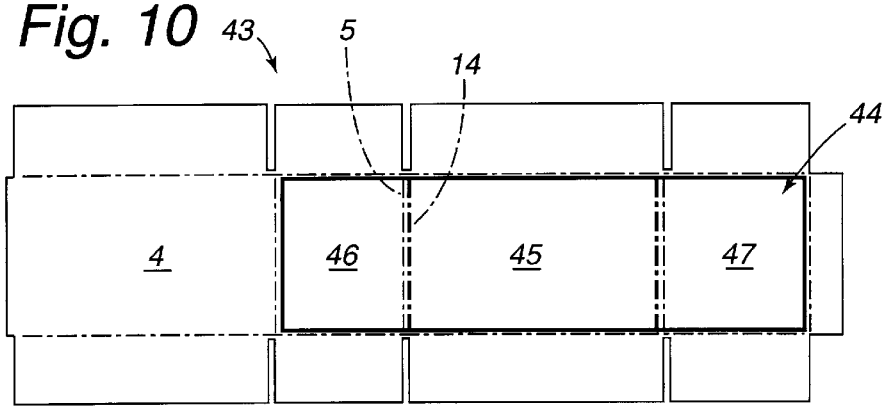

Fig. 12
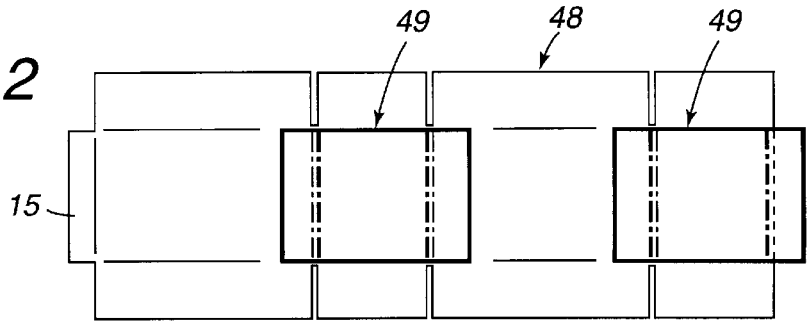
Fig. 13
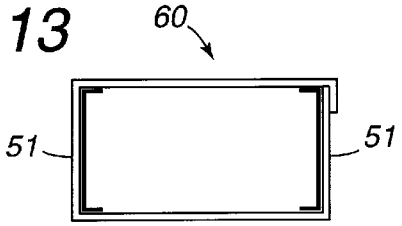
Fig. 15
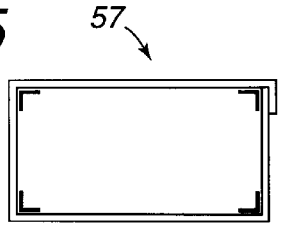
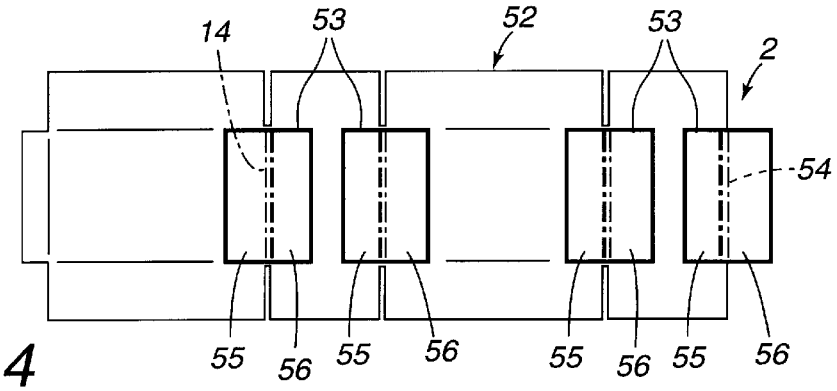
Fig. 14
Fig. 17
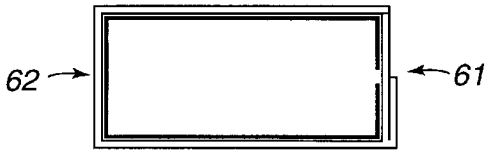
Fig. 16
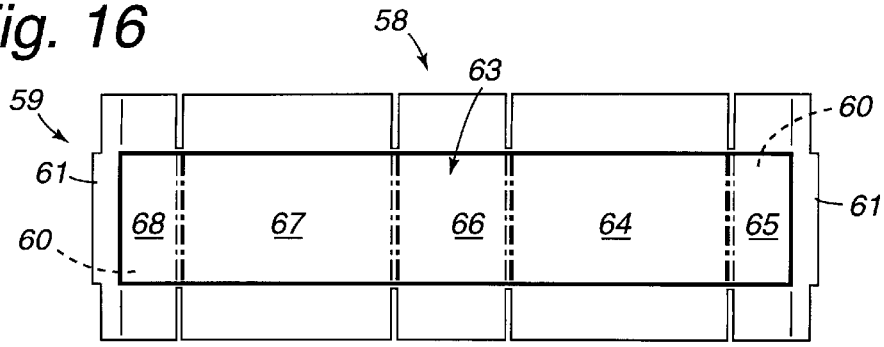

Fig. 18
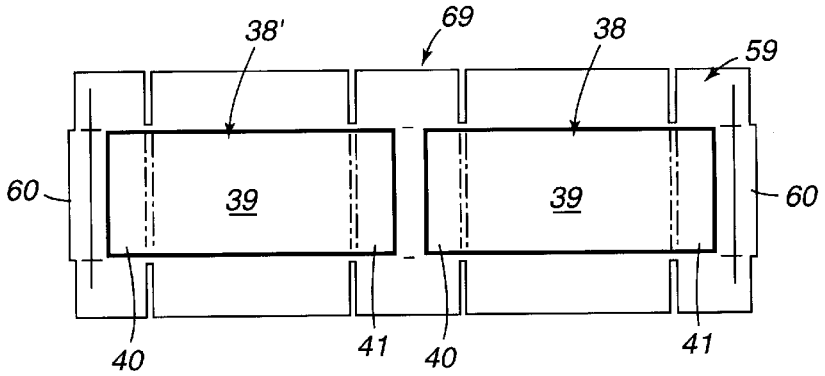
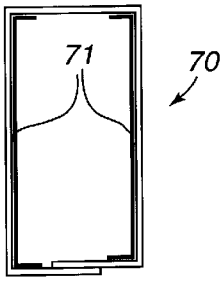
Fig. 19
Fig. 21
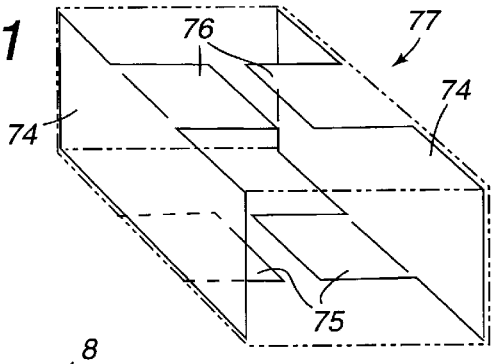
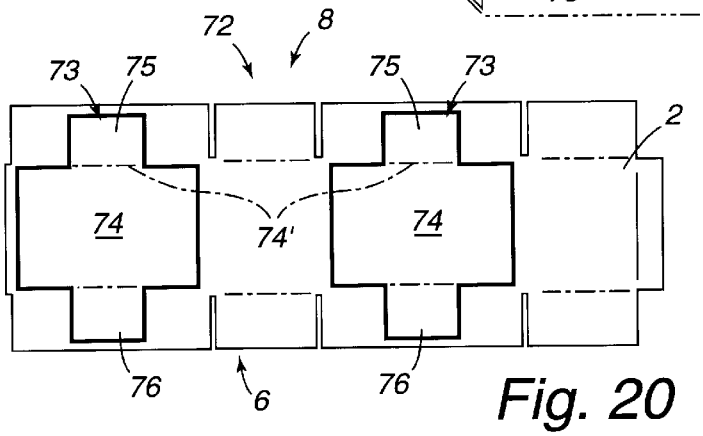
Fig. 20
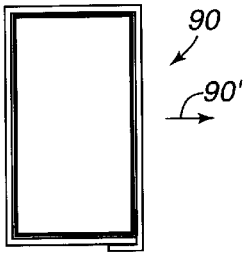
Fig. 23
Fig. 22
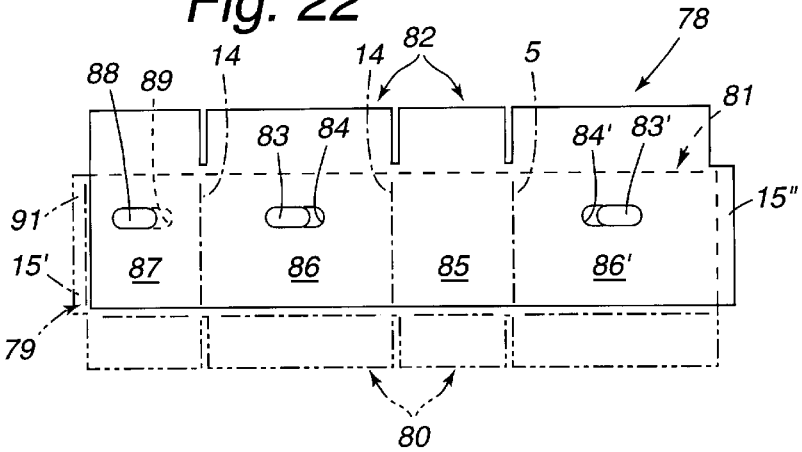

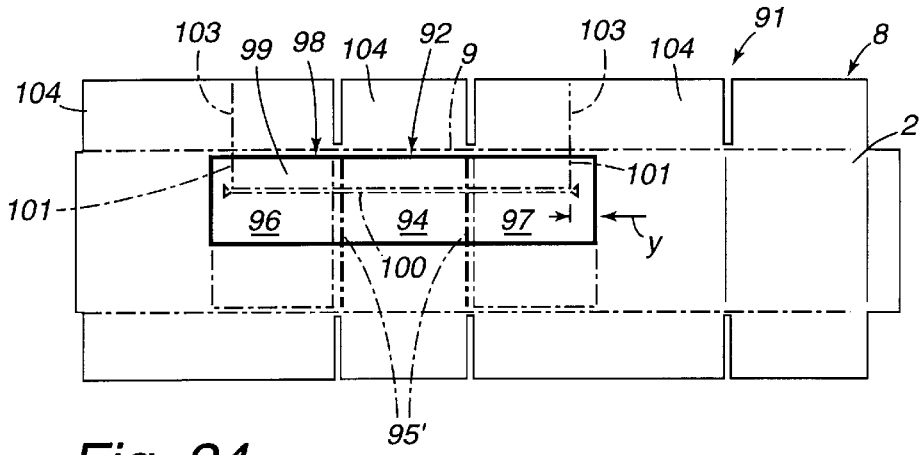
Fig. 24
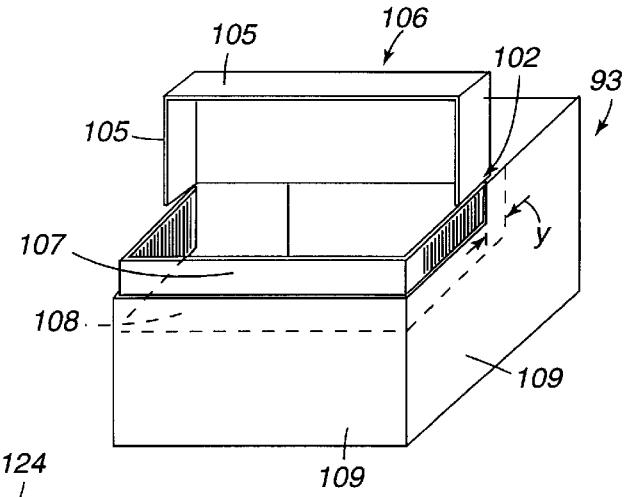
Fig. 27
Fig. 25
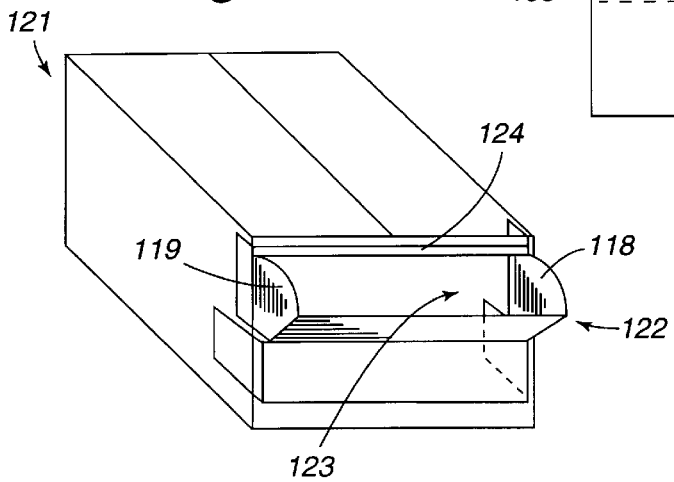
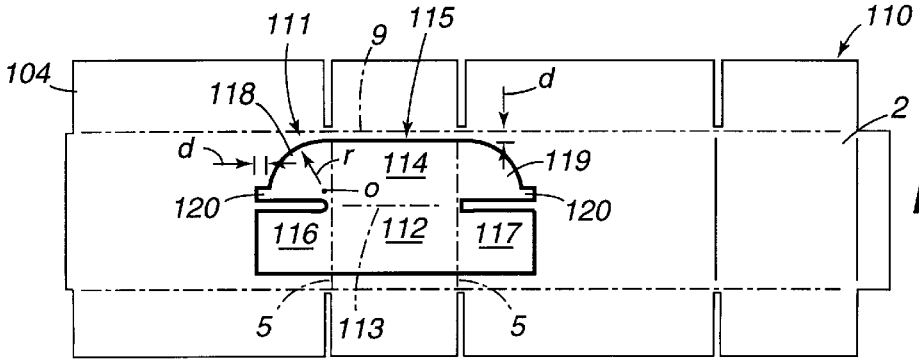
Fig. 26

SET OF BLANKS, BOX, METHOD AND MACHINE FOR MAKING A BOX FROM SAID SET OF BLANKS

The present invention relates to a set of blanks for constructing a packaging box of the type comprising at least two blanks made of a material in the form of sheets of board or corrugated board, namely a first blank comprising a series of at least four principal leaves ending in a fixing tab, said principal leaves being connected together via first fold lines parallel to each other, directly or via intermediate leaves, which series is provided on one side with a first series of flaps connected to said series of principal leaves by second fold lines perpendicular to said first fold lines, said series of leaves being able to form a ring of walls for the box and a second blank comprising at least two panels connected together by a third fold line, namely a first panel and one or more second panels.

It also relates to a box produced from such a set of blanks, as well as to the process and machine for making such a box.

It has a particularly important although not exclusive application in the field of reinforced corrugated board boxes, as well as in the field of boxes with added value, for example having a spout or a wall that holds back the loose products contained inside the box, after opening.

Reinforced boxes comprising a set of blanks of this kind are already known (U.S. Pat. No. 5,108,028). Such boxes have disadvantages in that they cannot be formed mechanically and do not offer sufficient stiffness.

The present invention alleviates these disadvantages.

The object of the invention is to provide a set of blanks, a box, a process and a box-making machine that fulfills mores satisfactorily than the prior art the needs of the field, notably in that it allows fast, efficient automatic assembly of the boxes but produces almost no waste, despite high throughputs.

The boxes produced also have good stiffness and great resistance to compression and destruction.

To this end the invention provides in particular a set of blanks for the construction of a packaging box of the type described above, characterized in that the second blank overlaps at least one fold line of the first blank, in that the first panel is fixed and/or centered on the first blank, in that said second panel or at least one of said second panels is fixed to said first blank by means arranged so as to permit relative movement of said second panel or panels with respect to the first blank when the box is being formed by a simultaneous rolling up of said prejoined blanks around a volume of defined dimensions, and in that the third fold line or lines of the second blank are laid out and positioned with respect to the corresponding fold lines of the first blank in order to enable the extra thicknesses of the sheets of board to be compensated for during said rolling up.

The fold lines according to the invention are simple, that is to say are designed to form an edge whose ridge is a single line.

In advantageous embodiments use is made of any of the following arrangements:

the means arranged so as to permit relative movement comprise a precut portion in said second panel or in the leaf opposite, and a hole that continues and is complementary in shape with said precut portion which is fixed nondetachably to the leaf of the first blank or to the second panel opposite it, in order to enable the extra thicknesses to be compensated for by the sliding of said portion in the plane and into said hole during rolling up.

The term "precut portion" denotes a breakable portion held by only a few points of attachment with the rest of the leaf and therefore easily detachable in the plane and/or perpendicular to the plane of said leaf or panel.

The means arranged so as to permit relative movement comprise means for connecting the second panel in such a way that it can slide in the plane relative to the first blank during rolling up;

the means of connection consist of cold glue with progressive tack, for example spots or lines or glue.

The term "glue with progressive tack" denotes a glue that stays pasty for a few seconds, for example 30 s, and so allows sliding to occur between blanks before definitive and rigid joining occurs.

The first and second blanks are fixed to each other purely by precut detachable portions.

Such an arrangement permits the further separation of the components of the box formed in this way, by detaching one from the other transversely and removing one from the other in an upward or downward movement;

the panels of the second blank are opposite the leaves of the first blank;

the set of blanks comprises two second blanks;

the second blank possesses a series of flaps connected to the panels by fourth fold lines perpendicular to the third fold lines;

the first blank is provided with a second series of flaps situated on the other side of the principal leaves from the first series of flaps, and connected to said leaves by fifth fold lines parallel to the second fold lines;

at least one panel of the second blank is opposite a flap;

the second blank comprises a series of at least three panels in which a longitudinal edge of said series of panels is adjacent to the fifth fold lines, and the first blank comprises, opposite said series of panels, a narrower longitudinal portion defined along one longitudinal side by said fifth fold lines and precut along its other longitudinal side and on its two lateral sides;

the second blank comprises a central panel opposite a first principal leaf of the first blank, in which the longitudinal upper edge is situated at a defined distance d from the fifth fold line corresponding to said first leaf, said central panel comprising on either side, opposite two second principal leaves situated on either side of said first leaf, two secondary panels that are symmetrical with respect to said central panel and not fixed to the first blank, in the approximate form of a quadrant, each terminating away from said fifth fold line in a tooth that projects out radially for a distance approximately equal to or less than d, while said principal leaf is cut opposite along its first and fifth fold lines;

the second blank comprises a fixing tab connected to the adjacent panel by a third fold line and extending along only part of the corresponding adjacent panel, opposite a part of, or displaced from, the fixing tab of the first blank;

the second blank comprises a fixing tab connected to the adjacent panel by a third fold line and situated at the opposite end from the fixing tab of the series of leaves of the first blank, outside of said first blank;

the second blank comprises a fixing tab that is connected to the adjacent panel by a third fold line, is situated at the same end as and opposite the fixing tab of the series of leaves of the first blank, and is of greater width;

the first blank has eight leaves, namely four principal leaves separated from each other by secondary leaves designed to form cut-off corners of the box;

one blank is made of corrugated board and the other is made of solid board;

the first blank is situated or arranged so as to be situated on the outside of the second blank or blanks when the box is formed;

the first blank is situated or arranged so as to be situated on the inside of the second blank or blanks when the box is formed.

The invention further proposes a box made with the set of blanks as described above.

Such a box is stiff, not pliable other than by destroying it.

It is also possible with the invention to produce a packaging box of polygonal section, formed from at least two blanks made from a material in the form of sheets of board or corrugated board, namely a first blank comprising a series of at least four principal leaves ending in a fixing tab, said principal leaves being connected together via first fold lines parallel to each other, directly or via intermediate leaves, said series of leaves forming the wails of the box and being connected on one side to a first series of flaps by second fold lines perpendicular to said first fold lines, said series of flaps forming the base of said box, and a second blank comprising at least two panels connected together by a third fold line, namely a first panel and one or more second panels, said second box forming a reinforcement or lid for said box, characterized in that the first panel is fixed on the first blank, the second blank overlapping at least one fold line of the first blank, and in that the second panel or at least one of said second panels is fixed to said first blank by means of arranged so as to permit relative movement of said second panel or panels with respect to the first blank when the box is being formed, said box being formed by a simultaneous rolling up of the prejoined blanks around a volume of defined dimensions, the third fold line or lines of the second blank being superimposed on the corresponding fold lines of the first blank.

Advantageously, the second blank comprises a portion that pivots out, at the upper end of one wall of the box, to form a spout.

In another advantageous embodiment, the second blank comprises a series of panels whose upper edge, adjacent to the upper edge of at least three adjacent walls of the box, is designed to form an internal upper reinforcement, and the first blank comprises a pivoting lid portion opposite this and fitting around said internal upper reinforcement of the box.

The invention further provides a process for constructing a polygonal-section packaging box of the type described above, characterized in that the flat second blank is at least partly fixed to the flat first blank with the third fold line or lines of the second blank displaced from the fold lines of the first blank to enable the extra thicknesses of the sheets of board to be compensated for, and the box is formed by a simultaneous rolling up of the blanks around the volume of defined dimensions, the first panel being held in position with respect to the first blank and the second panel or panels sliding with respect to the first blank during the rolling up.

Advantageously, when positioning the second blank on the first blank, at least one second panel is fixed to the first blank by connection means permitting relative movement of said second panel or panels with respect to the first blank.

In an advantageous embodiment the blanks are fixed together on the second panel or panels in a manner that temporarily allows sliding, for example with cold glue with progressive tack.

The invention further provides a machine for constructing a polygonal-section packaging box of the type described above, characterized in that it comprises means for positioning the second blank on the first blank, the third fold line or lines of the second blank being designed and positioned with respect to the first or second fold lines of the first blank in a displaced manner so as to permit said blanks to be rolled around said volume of defined dimensions with compensation for the extra thicknesses of the sheets of board, means for fixing at least one second panel to the first panel with glue to permit relative movement of said second panel or panels with respect to the first blank, the second blank overlapping at least one fold line, and means for forming the box by rolling the connected blanks around a volume of defined dimensions, permitting the second panel or panels to slide with respect to the first blank.

Certain advantageous embodiments also make use of any of the following arrangements:

means are provided for gluing the first panel to the second blank, the volume of defined dimensions is a polygonal-section mandrel;

the machine is arranged so that the volume of defined dimensions is formed by the products to be packed;

the means of gluing the second panels of the second blank to the first blank comprise injectors of cold glue with progressive tack;

with each blank comprising a fixing tab situated externally and at the opposite end of the series of leaves or panels from the other blank, the machine comprises means for folding the tab of the second blank onto the volume of defined dimensions, at the junction between the walls of the box, means for laying the opposing leaves of the first and second blanks on said tab, means for prefolding the tab of the first blank along the third fold line of the tab of the second blank and definitively laying said tab on the opposing wall of the box;

with each blank comprising a fixing tab situated at the same end of the series of respective leaves or panels, opposite each other, at the junction between the walls of the box, the fixing tab of the first blank being wider than the tab of the second blank so that it extends beyond the latter, said machine comprises means for prefolding the two tabs together around the volume, means for applying the tab of the first blank, and means for applying the tab of the second blank, for successive application of the two overlapping preglued tabs on the opposing wall or walls of the box.

The invention will be understood more clearly upon reading the description of the embodiments given below by way of non-restrictive example.

The description refers to the accompanying drawings in which:

FIGS. 1 and 1' show a first embodiment of a set of blanks according to the invention, in a top view and in longitudinal section.

FIG. 2 is a sectional view through the box produced with the set of blanks of FIG. 1.

FIG. 2' is a partial view on a large scale of a corner of the box shown in FIG. 2.

FIGS. 2A, 2A' and 2B, 2B' are sectional views of the first and second blanks of FIG. 1, respectively, in isolation, first shaped into a box and then opened out flat, showing the different widths of the leaves or panels and the offset positions of the fold lines.

FIG. 3 is a perspective view of the box produced with the blanks shown in FIG. 1.

FIGS. 4 and 5 show a second embodiment, firstly of a set of blanks according to the invention, and secondly of a box, in section, produced with such blanks.

FIGS. 6 and 7 show a third embodiment, firstly of a set of blanks according to the invention, and secondly of a box, in perspective, produced with such blanks.

FIGS. 8 and 9 show a fourth embodiment, firstly of a set of blanks according to the invention, and secondly of a box, in section, produced with such blanks.

FIGS. 10 and 11 show a fifth embodiment, firstly of a set of blanks according to the invention, and secondly of a box produced with such blanks in perspective.

FIGS. 12 and 13 show a sixth embodiment, firstly of a set of blanks according to the invention, and secondly of a box, in section, produced with such blanks.

FIGS. 14 and 15 show a seventh embodiment, firstly of a set of blanks according to the invention, and secondly of a box, in section, produced with such blanks.

FIGS. 16 and 17 show an eighth embodiment, firstly of a set of blanks according to the invention, and secondly of a box, in section, produced with such blanks.

FIGS. 18 and 19 show a ninth embodiment, firstly of a set of blanks according to the invention, and secondly of a box, in section, produced with such blanks.

FIGS. 20 and 21 show a tenth embodiment, firstly of a set of blanks according to the invention, and secondly of a box, in perspective, produced with such blanks.

FIGS. 22 and 23 show an eleventh embodiment, firstly of a set of blanks according to the invention, and secondly of a box, in perspective, produced with such blanks.

FIGS. 24 and 25 show a twelfth embodiment, firstly of a set of blanks according to the invention, and secondly of a box, in perspective, produced with such blanks.

FIGS. 26 and 27 show a thirteenth embodiment, firstly of a set of blanks according to the invention, and secondly of a box, in perspective, produced with such blanks.

In the remainder of the description identical box components and/or blanks will be denoted by the same reference numbers.

Figure 28B:
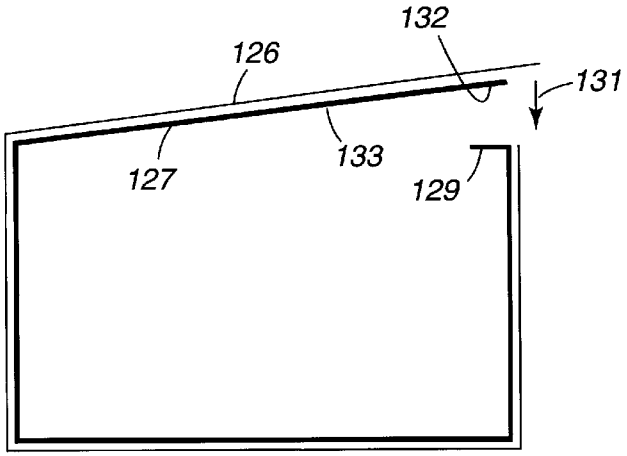
FIG. 28 shows the four final stages of the process of making a box in one embodiment of the invention.
Figure 28D:
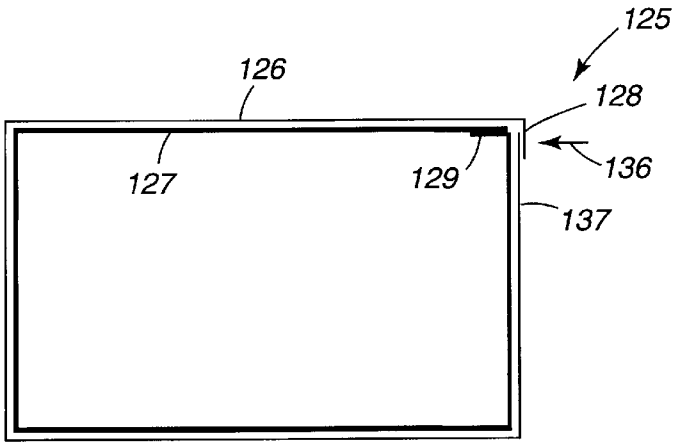
Figure 28A:
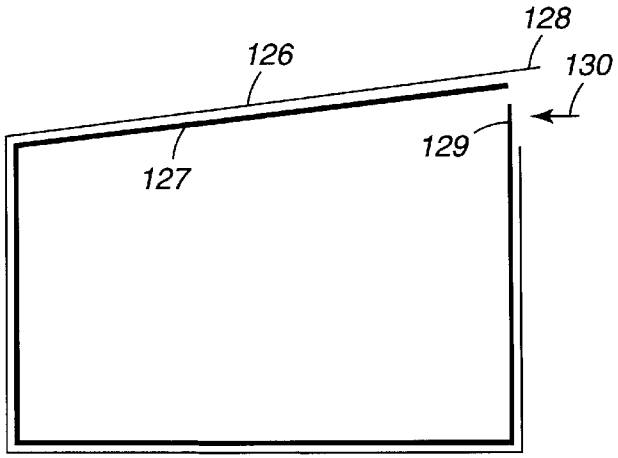
Figure 28C:
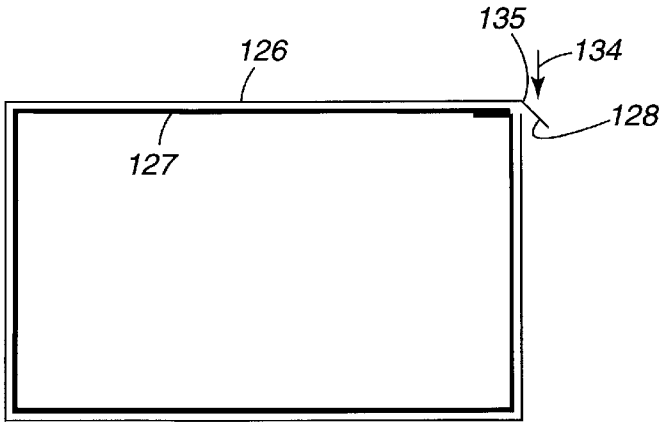
Figure 29C:
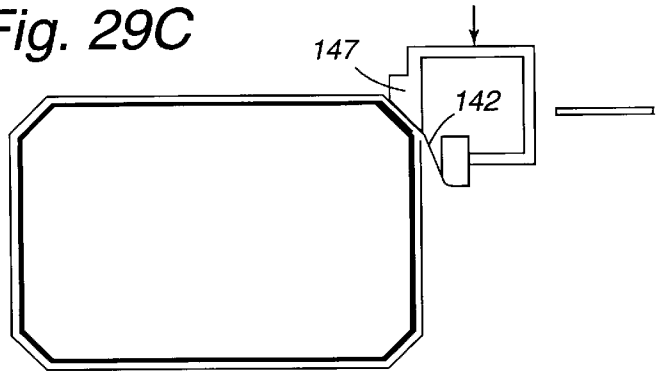
FIG. 29 shows the four final stages of the process of making a box in another embodiment of the invention.
Figure 29D:
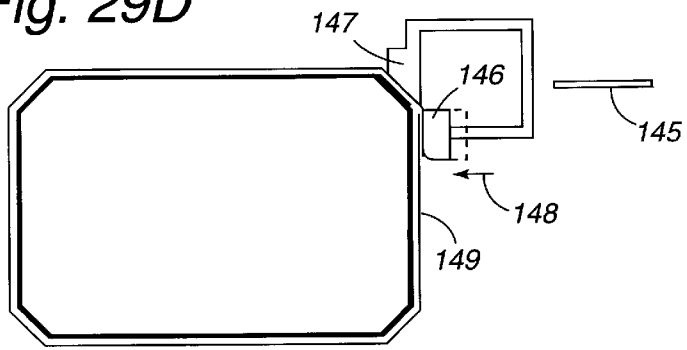
Figure 29A:
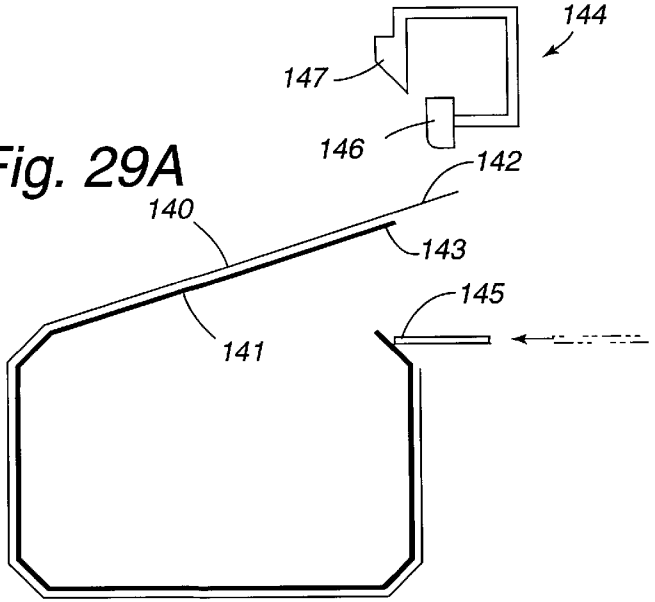
Figure 29B:
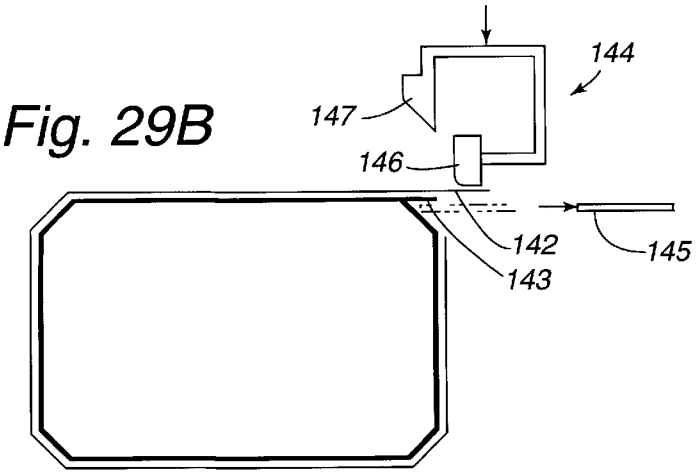

FIGS. 1, 1', 2, 2', 2A, 2B, 2A', 2B' and 3 show a set 1, or different components of a set, of blanks made of sheets of two-sided corrugated board, having a thickness of, for example, 2 mm.

This set 1 consists of a first blank 2 in thin lines in FIG. 1 and a second blank 3 in heavier lines placed on top of the first blank.

The first blank comprises a series of four rectangular leaves 4, for example two large leaves alternating with two small leaves, the leaves being connected together by first mutually parallel fold lines 5 shown in thin chain lines in the figure, the series of leaves 4 being designed to form the outer walls 4' of the four-sided parallelepiped box 1' (cp. FIGS. 2 and 3).

The series of leaves 4 is provided with flaps on each side, namely a first series of rectangular flaps 6 connected to the series of leaves by second fold lines 7 and designed to form the closed base 6'(see FIG. 3) of the box, of which two flaps touch along their outer edge, and a second series of flaps 8, identical to the flaps 6, connected to the adjoining leaves by fifth fold lines 9 and designed to form the lid 8' of the box 1'.

The second blank 3 comprises four rectangular panels, approximately of the same dimension as the corresponding leaves, namely a first central rectangular panel 10 and three secondary rectangular panels 11, 12 and 13 connected together by third fold lines 14, namely two panels 12 and 13 connected to either side of the central panel 10 and an end panel 11 connected to the other side of panel 12.

The first panel 10 is centered on and may be fixed nondetachably to a principle leaf 4 by adhesive bonding, for example with spots or lines (not shown) of so-called hot-melt adhesive.

FIGS. 2A, 2A', 2B and 2B' show the respective dimensions or width between the fold lines of the blanks 2 and 3.

These fold lines are laid out in such a way that the extra thicknesses are compensated for during folding.

More specifically (see FIGS. 2A, 2A', 2B and 2B') let $Li_1$: distance between the inside faces of two mutually opposing opposite walls of the first blank of the formed box.

$Le_1$: distance between the external faces of said walls of the first blank.

$li_1$: distance between the internal faces of the other two opposing walls of the first blank of the formed box.

$le_1$: distance between the external faces of said other walls of the first blank.

$e_1$: thickness of the first blank.

$P_1$: width of the fixing end tab.

$Li_2$: distance between the internal faces of two opposing walls of the second blank of the formed box.

$Le_2$: distance between the external faces of said walls of the second blank.

$li_2$: distance between the internal faces of the other two opposing walls of the second blank of the formed box.

$le_2$: distance between the external faces of said walls of the second blank.

$e_2$: thickness of the second blank.

In the embodiment of the invention described more specifically here, the following equations apply:

$$Li_1=Li_2+2e_2$$

$$li_1=li_2+2e_2$$

The distances between the first or third fold lines are also indicated in FIGS. 2B' and 2A', and are, in order, for the first blank:

between the edge 16 of the first leaf 4 and the first fold line 5: $Li_1+e_1$ between the two fold lines 5 of the second leaf: $li_1+e_1$ between the two fold lines 5 of the third leaf: $Li_1+e_1$ and between the two fold lines 5 of the fourth leaf: $li_1$ for the second blank:

between the edge 17 of the second panel 11 and the third fold line 14:

$$Li_1+0.5\times(e_1-e_2)-P_1$$

between the two fold lines 14 of panel 12:

$$li_1-e_2$$

between the two fold lines 14 of the first panel 10: $Li_1-e_2$ and between fold lines 14 and the extreme edge 18 of the second panel 13: $li_1-e_1-(0.5\times e_2)$.

The fold lines 14 of the first panel 10 are furthermore positioned at an equal distance x from the fold lines 5 of panel 4 (cp. FIG. 1').

Then:

$$x = \frac{Li_1 + e_1 - (Li_1 - e_2)}{2}$$

hence:

$$x = \frac{e_1 + e_2}{2}$$

The other distances between the fold lines are obtained simply by adding up the dimensions.

As we have seen, panel 10 is therefore extended on either side by two second panels 12 and 13 covering the adjacent flaps 4, while the series of panels ends in a final secondary panel 11 coinciding roughly with the last end leaf 4 of the first blank.

The other end leaf 4 of the first blank is extended by a fixing tab 15 whose width $P_1$ is approximately equal to that of the part 21 not covered by the panel, of the leaf 4 situated at the other end.

The second blank thus overlaps the fold lines 5 of the first blank.

In the embodiment described more specifically here, each of the second panels is fixed to the first blank by adhesive spots or lines (not shown) of e.g. progressive cold-setting adhesive to allow relative movement of the second panels relative to the first blank during the formation of the box by rolling the two blanks simultaneously about a volume of specific dimensions, for example a mandrel, the rolling of the blanks being effected before the definitive setting of the adhesive.

The displacements between third fold lines 14 relative to the first fold lines 5 allow the extra thicknesses to be compensated for.

In the illustrated embodiment described with reference to FIGS. 1 to 3, the first panel 10 is fixed nondetachably to the coinciding leaf of the first blank. The important point is that the first panel and the corresponding leaf must be held immovably against the mandrel while the blanks are being rolled up.

Another panel, for example an end panel, and its corresponding leaf may of course be taken as the reference or fixed point during rolling.

In addition, the upper and lower edges 19 and 20, respectively, of the series of panels 10, 11, 12 and 13 are situated adjacent to the fold lines 7 and 9 that connect with the series of lower flaps 6 and upper flaps 8 designed to form the base and the lid of the case, slightly displaced by a distance corresponding approximately to the thickness of the board so that during the formation of the base and lid there is no problem of excess thickness.

As has been seen, the outer leaf 4 is not entirely covered by the second panel 11, which leaves a rectangular area 21 at its end, the same size as the tab 15.

During the forming of the box therefore (cp. FIGS. 2A, 2B and 3), the outer longitudinal peripheral edge 22 of the tab 15 abuts against the extreme peripheral edge 17 to provide a double thickness around the entire periphery of the formed box 1 as can be seen at 23 in FIG. 2.

FIG. 4 shows a first blank 2 identical to the first blank of FIG. 1, but reversed, so that the tab 15 is situated at the other end of the blank.

In this embodiment the second blank 24 once again has four panels of the same transverse dimensions as the panels of the second blank 3 of FIG. 1, that is a first panel 10 fixed securely to the central leaf of the blank with the fold lines 14 being arranged as stated above with reference to FIGS. 1 to 3, with respect to the fold lines 5 of the first blank.

In addition, the second blank 24 has a first end panel 25 occupying the entirety or approximately the entirety of the area of the adjacent leaf 4 to which it is attached, a second end panel 26 and a fixing tab 27 which is connected to said adjacent panel 26 by a third fold line 28 that is displaced so that the extra thicknesses are compensated for during folding.

The tab 27 is situated at the opposite end from the fixing tab 15 of the first blank 2 and projects off the edge of said first blank.

FIG. 5 shows in section the box 29 produced with the two blanks of FIG. 4 when rolled around a mandrel.

The tabs 15 and 27 are therefore superimposed on and fixed to the respective extreme edges 30 and 31 of the leaf 4 and of the panel 26 at the junction where the box is closed upon itself.

FIG. 6 shows a set 32 of blanks, namely a first blank 2 and a second blank 33 for making the case 34 shown in FIG. 7 having double walls 34' on four panels.

As for the previous second blanks and in a more general way, the upper 35 and lower 36 longitudinal edges of the second blank are either set slightly further in than the fold lines 7 and 9 of the first blank, by a distance y equal or approximately equal to the thickness of the first blank, or immediately adjacent to or even coinciding with these fold lines.

In the last case, there is therefore a squeezing of the internal edges adjacent to the fold lines of the flaps, when the base and/or lid is folded together, the surprising effect of which is to give the pack greater resistance to compression.

Such folding with crushing is indeed only possible because there is a rolling around a specified volume.

Because the panel fixed along detachably to the first blank is panel 10, the fold lines 14 adjacent to it are therefore displaced towards the center of the panel away from the fold lines 5 of the first blank, and the displacements of the fold lines follow on from each other thereafter as described only with reference to FIG. 1.

Furthermore, the dimensions of the end panels are selected to ensure that the lateral edges 33' and 33" of the series come into contact during the formation of the box, the panels then forming an internal ring with joining ends.

For this purpose the edge 33' is flush, for example, with the fold line between the end leaf 4 and the tab 15, while the edge 33" is situated at a distance equal to the order of the thickness of the second blank, from the extreme edge 4' of said leaf 4.

FIG. 8 shows another embodiment of a set of blanks 37 comprising a first blank 2 and two identical second blanks 38 and 38'.

Each second blank comprises three panels 39, 40 and 41, the central panels 39 of each being fixed to a respective large leaf 4 of the first blank while the two small side panels 40 and 41, whose width may be equal to, for example, one third of the leaf of the first adjacent blank, are, in the case of one of the second blanks (38) mounted so as to be able to slide relative to the leaves adjacent to the large leaf 4, by means of, say, spots of cold glue, and in the case of the other (38') are fixed, one slidably to the adjacent leaf 4, while the other projects beyond the end of the first blank.

The resulting box 42 (see FIG. 9) thus shows an external ring structure having two internal lateral U-section reinforcements.

FIG. 10 shows a set 43 of blanks according to the invention, this time comprising a single second blank 44 having three adjacent panels, namely a first panel 45 and two identical second panels 46 and 47 situated on either side of the first panel 45 and connected by fold lines 14 that are displaced relative to the fold lines 5 as described earlier, the two second panels covering two small leaves 4.

The fourth principal leaf 4 (large leaf in the example) situated at the end of the first blank remote from the fixing tab 12 is not covered by said second blank.

FIG. 11 shows the perspective view of the box 47 obtained with the blank 43, which is therefore only reinforced on its base and side walls, the base being formed by one of the principal leaves 4 of the box.

FIG. 12 shows another set 48 of blank s comprising two second blanks 49.

The two second blanks are of the same type as those described with reference to FIG. 8 but are centered on the smaller principal leaves rather than on the large principal leaves, which gives a case 50 reinforced on its two small sides 51 (see FIG. 13).

FIG. 14 shows another set 52 of blanks comprising a first blank 2 and four identical second blanks 53, namely three second blanks laid across the fold lines 5 between leaves of the first blank and a fourth second blank at the end overhanging the peripheral edge 54 of the end leaf furthest from the fixing tab 15 and positioned centrally relative to this edge.

The four second blanks are rectangular and formed by two identical panels 55 and 56, with one optionally fixe d nondetachably to the corresponding leaf, and the other attached at least temporarily slidably to the adjacent leaf, the third fold lines 14 being displaced from the first fold lines 5 of the first blank, to allow for the extra thicknesses.

This produces a case 57 in which the four corners are reinforced by angle brackets, as can be seen in FIG. 15.

FIG. 16 shows another set 58 of blanks according to the invention.

In this embodiment the first blank 59 comprises five principal leaves, the two end leaves 60 being intended to overlap at rectangular portions 61 that form tabs and continue said leaves upwards, as illustrated on the case 67 shown in FIG. 17.

This case is totally reinforced by a second blank 63 having five panels laid out in accordance with the invention, namely: a first panel 64, optionally integral with a large leaf of the first blank before being rolled around the mandrel, nondetachably, provided on one side with a small panel 65 able to be superimposed on and fixed slidably to an end leaf 60 and on the other side with a series of three panels 66, 67 and 68 each located approximately over the three corresponding leaves.

FIG. 18 shows a set 69 comprising a first blank 59 identical to that of FIG. 16, having two second blanks 38 and 38' arranged symmetrically, each second blank comprising three leaves, namely a first central leaf 39 and two small side leaves able to be positioned over the two end leaves 60 of the first blank, specifically leaf 40 in the one case and leaf 41 in the other case.

This gives a case 70 in accordance with FIG. 19 made up of an external ring with two internal reinforcements 71 on either side forming a U in cross-section.

FIG. 20 shows another embodiment of a set 72 according to the invention, comprising a first blank 2 and two second blanks 73 having a first central panel 74 bonded adhesively to and centered on the principal leaf 4, with which it approximately coincides.

Each second blank also comprising, on either side of the first panel 74, two second rectangular side panels 75 and 76 that are symmetrical with respect to the first panel to which they are connected by fold lines 74' parallel to the fifth fold lines 9 but displaced towards the middle of the panel in an embodiment of the invention more particularly described here, and central with respect to, and equal in width to for example one third of the width of the first panel, and laid out in such a way as to slide temporarily over two corresponding flaps on the series of flaps 6 and 8.

FIG. 21 is a schematic perspective view of the reinforcing second blanks 73 in the box 77 according to the invention, comprising therefore two opposite large reinforcing panels, each glued to one wall of the case and connected to two small central panels perpendicular to the first panels, likewise glued with the temporary possibility of sliding, for example by progressive setting of paste.

FIG. 22 shows another embodiment of a set 78 of blanks, in which the second blank 79, whose leaves are identical to those of blank 2, possesses flaps 80 on one side only, and in which the first blank 81, identical in shape to the second blank 79, except for the end tab being in the reverse position with respect to the first blank, possesses flaps 82 on the other side.

More specifically and as an example, the first blank comprising a small rectangular leaf 85 which is not fixed to the second blank which is designed and positioned in such a way that the lateral fold lines 14 are displaced relative to the fold lines 5 as described with reference to FIG. 1 in respect of panel 10.

The blanks of FIG. 22 are upside down compared with those of FIG. 1 so that the first blank in FIG. 22 is situated in the foreground compared with the second blank.

Connected on either side of the leaf 85 is a large rectangular leaf 86 (86') having the oval detachable portions 83 (83') of small dimensions compared with the leaf, for example of between ⅓ and 1/20 of the area, for example 1/10, and are glued to the corresponding panel of the second blank, the remaining area of the leaves 86 (86') not being fixed to said second blank.

The leaf 86 is connected on its other side to a fourth leaf 87 which also has a detachable portion 88 fixed to the second blank, the rest of the leaf 87 again being free with respect to said second blank.

The detachable portions can be fixed to the corresponding leaf by cold glue with progressive tack in, for example, spots or dashes of glue that will spread during rolling about the mandrel, then without spreading beyond the area of said portion.

In the embodiment more particularly described here, each portion 83, 83' and 88 is fixed with hot-melt adhesive and is extended in the direction of the flap 85 by a hole 84, 84' and 89 having the same width measured transversely to the series of leaves as said portions, and of sufficient length to compensate for the sliding of the portions detached transversely during the forming of the box 90 (see FIG. 23), and therefore the sliding of the leaves 86, 86' and 87 of the first blank with respect to the second.

In other words the portions 83, 83' and 88, each integral with a respective leaf of the first blank and detaching itself in the plane of the first blank during rolling, fit into the complementary holes 84, 84' and 89 in the continuation of said portions.

The end tabs 15' and 15" (equivalent to tab 15 of blank 2 of FIG. 1) of the second and first blanks, respectively, are also designed and laid out so as to close, as described by way of a more specific example with reference to FIG. 28.

In this embodiment, after the box has been formed, it is also possible to completely separate the two blanks, which form two open boxes one inside the other, by first removing the portions from their respective holes by applying pressure perpendicularly to the walls (arrow 90') of one formed blank from the other.

As has been seen, the portions may be fixed nondetachably with holes.

However, it is also possible to fix the detachable portions in such a way that they can slide during the forming of the box and become definitively attached later once the box is formed.

In this case there is no need for the holes that compensate for the play, although it is always possible to detach the first blank from the second blank once the box is formed.

In one embodiment of the invention the precut and detachable portions are situated on the inside of the box, and will therefore be in direct contact with the mandrel during detachment.

FIG. 24 shows a set 91 comprising a first blank 2, and a second blank 92 for closing a box 93. This can be used, for example, for holding loose products such as washing powder or other products.

The second blank 92 has a central panel 94 against a first principal leaf 4 of the first blank connected on either side by fold lines 95 displaced towards the middle 6f the panel relative to the fold lines 5 of the first blank and two secondary panels 96 and 97 which are symmetrical with respect to the central panel 94.

The central panel 94 is fixed to the principal leaf of the first blank, for example by hot-melt adhesive, the upper longitudinal peripheral edges 98 of the second blank being adjacent to the fifth fold lines 9 of the first blank.

The first blank includes a longitudinal portion 99 whose longitudinal dimension is shorter than the dimension of the second blank formed by the series of panels 94, 96 and 97 by for example a distance 2×y of a few millimeters.

The second blank is thus slightly longer at each side by a distance y of for example 5 mm.

It is also taller than the portion 99, which is bounded on one side by said fifth fold lines 9 and precut along the other longitudinal side 100 and along its two lateral sides 101, so that when the box 93 is formed (cp. FIG. 25) a lid is formed that can be partially opened about a hinge 102 formed by fold lines 103 running transversely across the flaps of the series 8 at right angles to the fold lines 9 and in line with the lateral side 101 of the portion 99.

The edges 105, formed by the portion 99, of the opening part 106 of this lid fit around the edges of the end portions 107 of the second blank, whose lower portion 108 is fixed to the wall 109 of the box.

FIG. 26 shows another set 110 in an embodiment of the invention comprising a first blank 2 and a second blank 111 and a first fixed rectangular central panel 112 opposite a first principal leaf which is precut at the top.

The first panel 112 is connected by a fold line 113 parallel to the second fold lines 7 to an identical second central panel 114 whose longitudinal edge 115 is situated at a specific distance d form the fifth fold line 9 corresponding to said first leaf.

The first central panel comprises on either side, opposite to, and fixed in such a way as to compensate for play to two second principal leaves situated on either side of said first leaf, two rectangular symmetrical second panels 116 and 117 connected by fold lines 14 that are displaced as described earlier from the fold lines 5.

The second central panel 114 comprises two symmetrical panels or lugs 118, 119 in the form of quadrants of defined radius, the center O of which is at a distance D from the fifth fold line and of radius r such that $D \geqq r+d$, and advantageously $D=r+d$.

At the bottom of the quadrant, that is to say the radius parallel to the fifth fold lines and in its continuation, each panel 118 and 119 comprises a tooth 120 projecting from the perimeter of the quadrant to a height approximately equal to d.

Neither of these two secondary panels is fixed to its adjacent principal leaf, and so will be able to slide.

The set of blanks 110 produces the box 121 with a spout 122 as shown in FIG. 27: the panels 118 and 119 can pivot with friction against the inside 123 of the walls of the corresponding case, their movements being blocked by the teeth 120 when the latter come into contact with the top band 124 of the box situated above the spout and corresponding to a portion of the first blank that is not cut along the above-mentioned distance d.

Shown in FIG. 28 are the final stages (A, B, C and D) in the formation of a box 125 in accordance with one embodiment of the invention.

In this version each blank, namely the first or outer blank 126 and the second or inner blank 127, comprise a fixing tab 128 and 129, respectively, situated on the outside and at opposite ends of the series of leaves or panels of the other blank.

Tab 129 of the second blank 127 is pre-folded (stage A, arrow 130) onto the module (not shown) of defined dimensions and the opposing first and second blanks are then (stage B, arrow 131) applied to said tab and the volume of defined dimensions.

The preglued inner end 132 of the end panel 133 is thus brought down on the outside of the tab 129.

Next (stage C, arrow 134), tab 128 of the first blank is prefolded along the third fold line 135 of the tab and/or of the peripheral edge of the opposing end panel of the second blank, and the folding of the preglued tab 128 of the first blank is completed (stage D, arrow 136) by attaching it to the opposing wall 137 of the box.

FIG. 29 shows the final stages of a process according to another embodiment according to the invention for making an eight-sided box around a mandrel (not shown).

The set comprises two blanks 140 and 141.

Each blank comprises a fixing tab 142 and 143, respectively, situated at the same end of the respective series of leaves or panels and displaced with respect to each other at the junction between the walls of the box.

The fixing tab 142 of the series of leaves of the first blank 140 is of greater width, for example twice as wide, (for example 6 cm), as the tab 143 of the second blank, (for example 3 cm in width), so that it projects beyond the latter as illustrated in FIG. 29 (stage A).

For the purpose of the folding, particularly around the cut-off corner of the mandrel, additional use is made of a specific device 144 able to apply pressure in two stages.

A first part 145 of the end leaf of the second blank is first pressed onto the mandrel. The two preglued tabs 142 and 143 are then folded along the upper edge of the cut-off corner.

For this purpose pressure is applied to the tab 142 of the first blank by a pushing block 146 (stage B) that moves transversely relative to the mandrel and belongs to the device 144, and then by a cut-off wedge 147 (stage C).

In this way the tab 143 is applied to the opposing end panel, pressure being applied against the cut-off corner of the mandrel, and then by a complementary transverse movement (arrow 148) (stage D) the tab 142 of the first blank is applied to the outside wall 149 of the packaging, the tab 143 disappearing under the tab which folds it to form a corner comprising four thicknesses of board.

Figure 30:
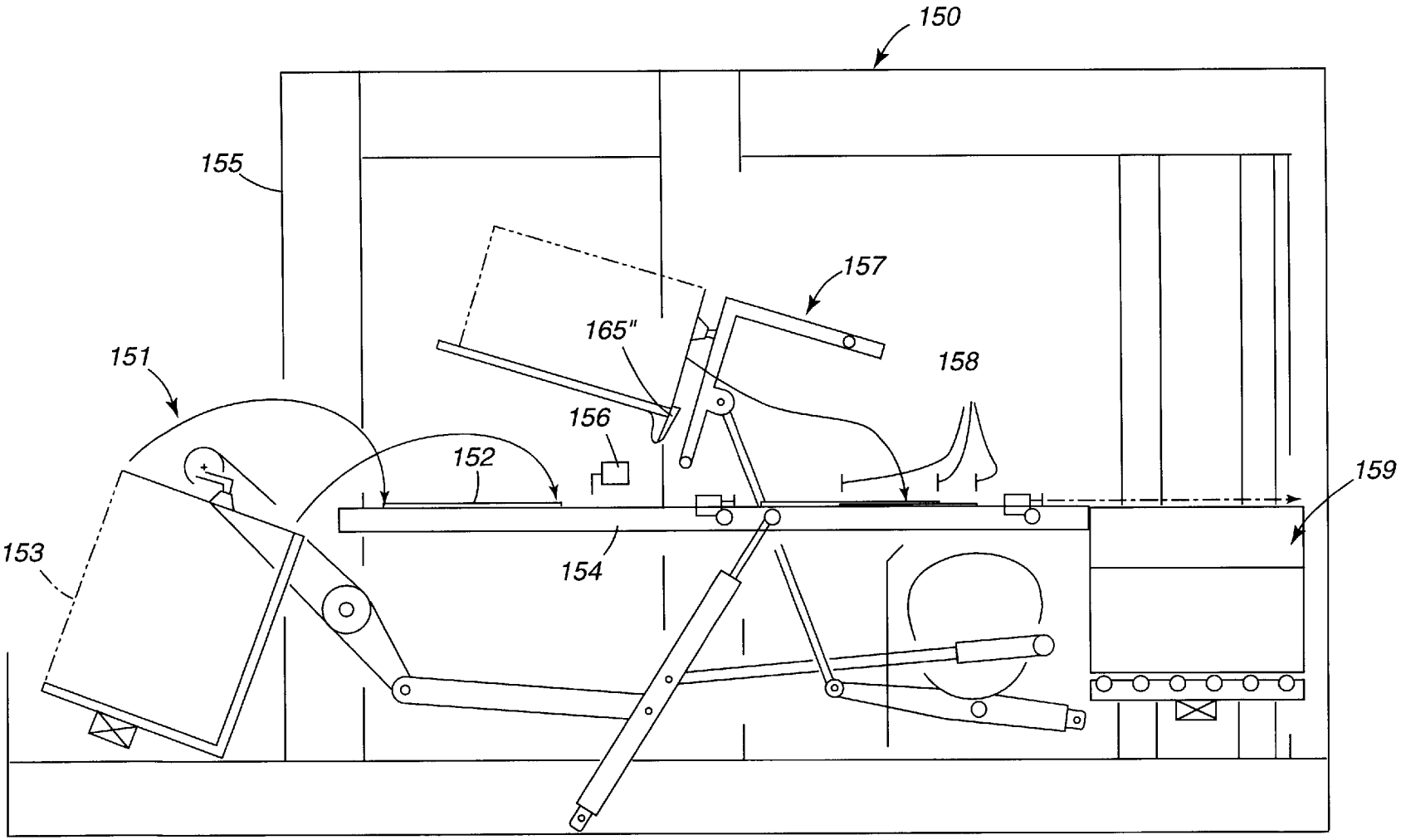
FIG. 30 is a schematic side view in elevation of a machine for making a set of blanks according to the invention.
Figure 31:
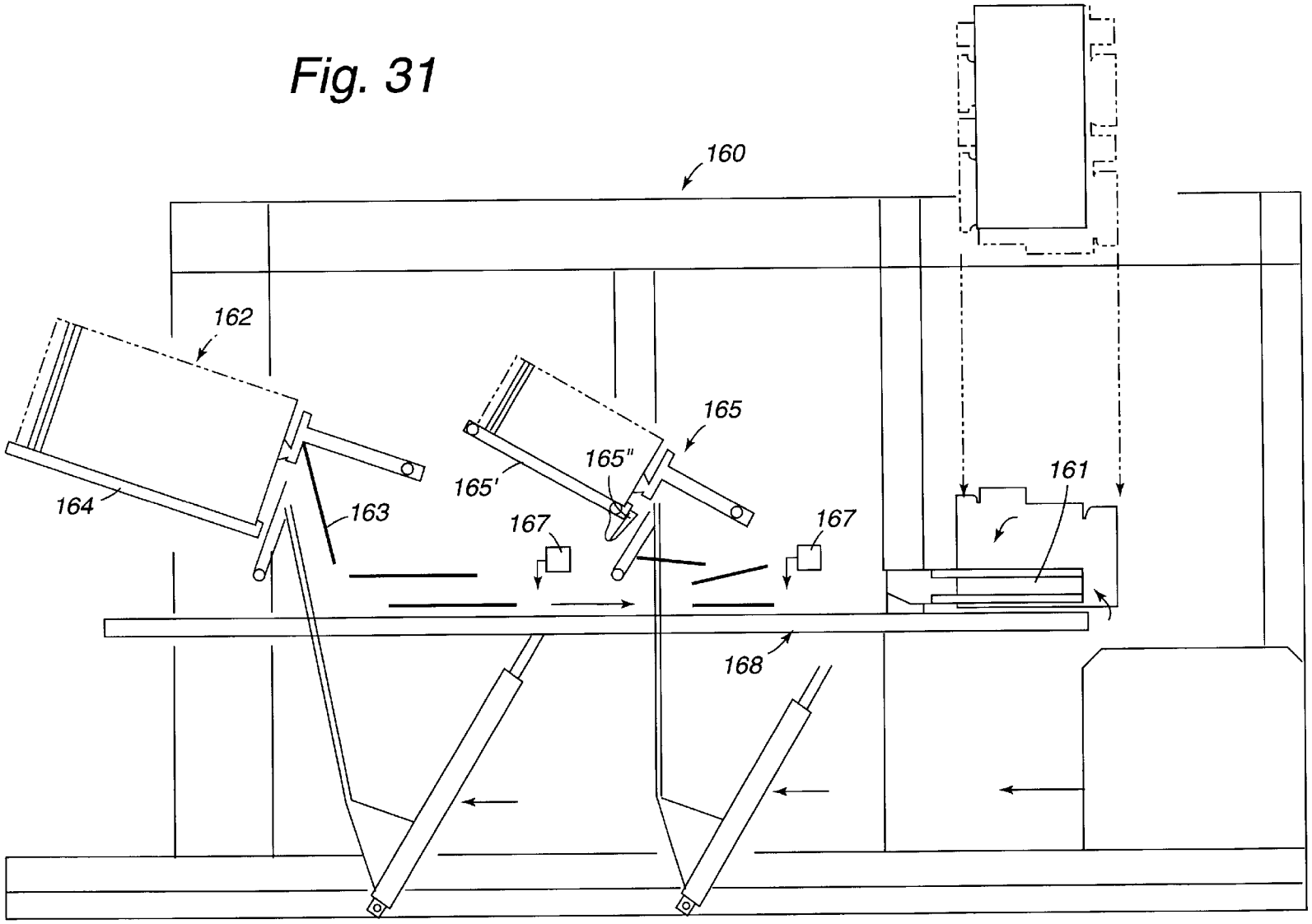
FIG. 31 is a schematic side view in elevation of a first embodiment of a machine according to the invention.
Figure 32:
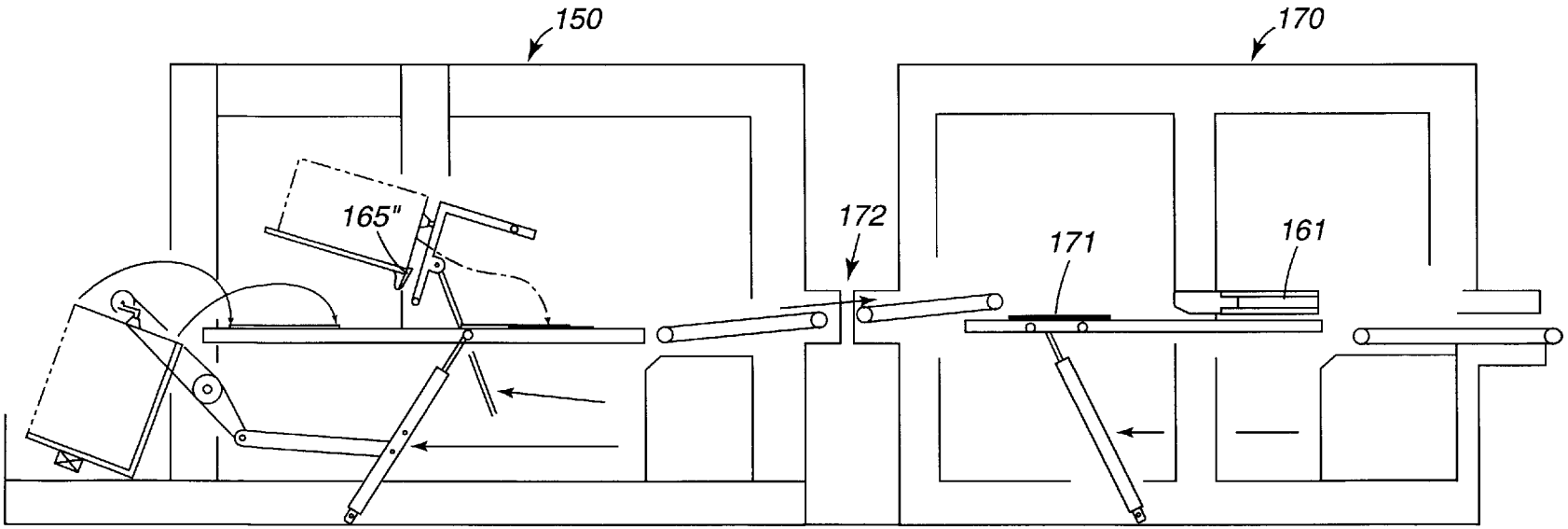
FIG. 32 is a schematic side view in elevation of a second embodiment of a machine according to the invention.

Shown in FIGS. 30, 31 and 32 are embodiments of machines for the automatic making of boxes according to the invention.

The machine 150 in FIG. 30 comprises a first device 151 of known type for taking the first blanks 152 one by one, for example by suction, from a magazine 153 and depositing them precisely on a mobile table 154 mounted on a frame 155.

Glue applicators 156, for applying hot-melt adhesive or cold glue, of known type, mounted on the frame 155, deposit lines or spots of adhesives on the leaves in the intended positions for fixing to the panels.

A second device 157, similar to the first, accurately deposits, with an accuracy of less than one millimeter, the second blank on the first blank which is butted against the registration means 158, after gluing the first blank as stated, partly on the leaf 4 opposite to the principal panel if appropriate, and partly—and for example if using the machine with sets of blanks of the type described with reference to FIG. 22—opposite the precut portions of the secondary panels, with hot-melt adhesive.

The means by which the second blank is deposited on the first blank are also detailed below.

As has been seen, this system of gluing a precut part of the second blank to the first blank enables the extra thicknesses to be compensated for by detaching it and sliding it within a hole in the corresponding panel.

Thus assembled, the sets of blanks are then passed on to an intermediate holder 159 where they are stored flat.

FIG. 31 shows a machine 160 according to the invention for making a box around a mandrel 161.

The assembly that rolls the board around the mandrel is of the type described in document FR-A-2,629,012, which is incorporated here by reference, with mobile arm unit (not shown).

A first device 162 with a gripping sucker transfers the first blank 163 from a store 164 of blanks (known per se) to a moving belt.

A second device 165 similar to the device 157 supplies the second blank 166.

It deposits it with great accuracy on the first blank, which is preglued by means 167 as described above.

The accuracy with which the second blank is positioned on the first blank is given, in the example more particularly described here, by the construction of a store or magazine supplying the second device with second blanks, as described below.

The second blanks are stood on edge and inclined at an angle of between 10° and 40° to the vertical on a system 165' of two or three driven bands parallel to the direction of movement.

The forward movement of the bands is controlled by two feelers 165" situated on either side of the magazine at the foot of the blanks.

Each feeler is composed of a rod approximately perpendicular to the blades and situated at the lower extremity of the sloping magazine, at the end from which the second blanks are removed.

Said rod pivots on a lower spindle and has a return spring tending to return the top of the rod to a position slightly proud of said bands, thus playing the role of a pivoting stop device when the second blank is being taken out by suction.

The system of feelers enables the blanks to be forwarded with strictly identical registration at their lower edge.

The regularity and repeatability of this position provides the accuracy of deposition of the blank which is then gripped in a known way by suction.

The system of mechanical cams and lever arms offers perfect repeatability of the movement of displacement of said blank gripped by suction between the magazine and the position of deposition on the first blank.

The resulting assembled set of blanks is then moved by running gear 168 in a manner known per se, beneath the folding mandrel around which the case is formed by means of, among other things, pivoting arms which envelope the leaves of the blanks and wrap them around the mandrel, and of a plate, or other pressure means, which first centralizes the leaf and the lower panel with respect to, and on, the lower horizontal force of the mandrel and then presses them into this position before closing the flaps forming the base of the box by gluing them to the others, as described in documents FR-A-2,629,012 or FR-A-2,665,137 cited above.

The boxes thus formed are removed by ejection, for example by pushing on the formed base from inside the mandrel.

FIG. 32 shows another embodiment of the invention. This time it comprises two frames, that is to say one frame corresponding to a machine 150 as described with reference to FIG. 30 for making a set of blanks, and one machine 170 for making the box itself by rolling them together, the extra thicknesses being compensated for.

The two machines for making the set of blanks and forming the box properly so-called can thus be disassociated and installed in geographically different locations, unlike the embodiment shown in FIG. 31.

The sets of blanks 170 are conveyed for example by conveyor belts 172 known per se, instead of being stored on pallets.

The resulting formed boxes are then removed in a manner known per se.

A detailed description will now be provided of one embodiment of the process of making a box according to the invention making particular reference to FIGS. 22, 28 and 31.

The first blank 81, which is to form the outer ring of the box 90, is taken from the magazine 162 by suction and placed flat and horizontally on means of movement known per se, with its flaps 82 toward the mandrel.

The correctly guided blank is then brought horizontally on the hot-melt gluing means 167 which inject three spots of glue from above onto the portions 83, 83' and 88 of the first blank.

The first blank is then passed under the magazine supplying the second blank 81 which is simultaneously gripped by suction, before being laid on the first blank in such a way that said second blank's fold lines 14, which are appropriately positioned, are displaced relative to the fold lines 5 of the first blank as indicated in the invention.

The two blanks, joined by the portions 83, 83' and 88 only, are then fed toward the mandrel. Lines or spots of hot-melt adhesive are deposited on the tab 15" and the extreme edge of the funnel of the second blank intended to be joined to the tab 15', as well as to the flaps 82 whose purpose is to fix the outer face of the base of the box.

The assembled blanks are brought to a mandrel having four edges (equivalent to the mandrel 161 with eight edges illustrated in FIG. 31 for an eight-sided box).

The leaf 85 and the corresponding panel are placed underneath the lower face of the mandrel at a defined distance.

They are then moved progressively closer, for example by a pusher plate.

A system of mobile arms wraps the series of leaves 86, 87 around one side of the mandrel, and a leaf 86' and tab 15" around the other side, successively wrapping leaves 86 and 87, thereby detaching portions 83 and 88 which move into the corresponding holes 84 and 89, and wrapping leaf 86, thereby detaching portion 83' and moving it into the hole 84'.

The end of the sequence is that described with reference to FIG. 28.

The flaps 82 are then folded in turn against the base of the mandrel and glued together in the known way.

The box is then ejected, for example by pushing on the base with the mandrel.

In this way a box is obtained with a closed base and with the flaps 80 open.

To fill the box it is stood on its base, composed of the joined flaps 82.

After filling, the box can be closed by folding the small flaps 80 about their respective fold lines joining them to the panels of the second blank 79 and then folding the two large flaps 80 onto the small folded flaps, after first gluing the latter so that the flaps are stuck together.

The result is the case formed in accordance with the embodiment of the invention more particularly described here.

It goes without saying, and can indeed be deduced from the foregoing, that the present invention is not limited to the embodiments more particularly described.

We claim:

1. Set (1, 32, 37, 43, 48, 52, 58, 69, 72, 78, 91, 110) of blanks for constructing a packaging box, comprising at least two blanks made of a material in the form of sheets of board or corrugated board, namely a first blank (2, 48, 59, 81, 126, 140) comprising a series of at least four principal leaves (4; 85, 86, 87, 86') ending in a fixing tab (15, 15", 61), said principal leaves and said tab being connected to each other via first fold lines (5) parallel to each other, directly or via intermediate leaves, which series is provided on one side with a first series (6, 82) of flaps connected to said series of principal leaves by second fold lines (7) perpendicular to said first fold lines, said series of leaves being able to form a ring of walls for the box and a second blank (3, 24, 33, 38, 38', 44, 49, 53, 63, 73, 79, 92, 111, 127, 141) comprising at least two panels (10, 11, 12, 13; 25, 26; 39, 40, 41; 45, 46, 47; 49; 55, 56; 64, 65, 66, 67, 68; 74, 75, 76; 94, 96, 97; 112, 114, 116, 117, 118, 119) connected together by a third fold line (14, 74', 95, 113), namely a first panel and one or more second panels, characterized in that the second blank overlaps at least one fold line of the first blank, in that the first panel is fixed and/or centered on the first blank, in that said second panel or at least one of said second panels is fixed to said first blank by means (83, 83', 84, 84', 88, 89) arranged so as to permit relative movement of said second panel or panels with respect to the first blank when the box is being formed by a simultaneous rolling up of said prejoined blanks around a volume (161) of defined dimensions, and in that the third fold line or lines (14, 74', 95, 113) of the second blank are laid out and positioned with respect to the corresponding fold lines of the first blank in order to enable the extra thicknesses of the sheets of board to be compensated for during said rolling up.

2. Set of blanks according to claim 1, characterized in that the means arranged so as to permit relative movement comprise a precut portion in said second panel or in the leaf opposite, and a hole that continues and is complementary in shape with said precut portion which is fixed nondetachably to the leaf of the first blank or to the second panel opposite it, in order to enable the extra thicknesses to be compensated for by the sliding of said portion in the plane and into said hole during rolling up.

3. Set of blanks according to claim 1, characterized in that the means arranged so as to permit relative movement comprise means for connecting the second panel in such a way that it can slide in the plane relative to the first blank during rolling up.

4. Set of blanks according to claim 3, characterized in that the means of connection consist of cold glue with progressive tack.

5. Set of blank according to claim 1 characterized in that the first and second blanks are fixed to each other purely by precut detachable portions.

6. Set (1, 32, 37, 43, 48, 52, 58, 69, 78, 91, 110) of blanks according to claim 1 characterized in that the panels (10, 11, 12, 13; 25, 26; 39, 40, 41; 45, 46, 47; 49; 55, 56; 64, 65, 66, 67, 68; 94, 96, 97; 112, 114, 116, 117, 118, 119) of the second blank are opposite the leaves of the first blank.

7. Set (37, 48, 69, 72) of blanks according to claim 1, characterized in that it comprises two second blanks (38, 38', 49, 73).

8. Set (78) of blanks according to claim 1 characterized in that the second blank (81) possesses a series of flaps (82) connected to the panels by fourth fold lines perpendicular to the third fold lines (14).

9. Set (1, 32, 37, 43, 48, 52, 58, 69, 78, 91, 110) of blanks according to claim 1 characterized in that the first blank (2) is provided with a second series (8) of flaps situated on the other side of the principal leaves from the first series of flaps, and connected to said leaves by fifth fold lines (9) parallel to the second fold lines.

10. Set (72) of blanks according to claim 1 characterized in that at least one panel (75, 76) of the second blank (73) is opposite a flap.

11. Set (91) of blanks according to claim 9, characterized in that the second blank (92) comprises a series of at least three panels (94, 96, 97) in which a longitudinal edge (98) of the series of panels is adjacent to the fifth fold lines (9), and in that the first blank (2) comprises, opposite said series of panels, a narrower longitudinal portion (99) defined along one longitudinal side by said fifth fold lines and precut along its other longitudinal side (100) and on its two lateral sides (101).

12. Set of blanks according to claim 9, characterized in that the second blank (111) comprises a central panel (112, 114) opposite a first principal leaf of the first blank, in which the longitudinal upper edge (115) is situated at a defined distance d from the fifth fold line (9) corresponding to said first leaf, said central panel comprising on either side, opposite two second principal leaves situated on either side of said first leaf, two symmetrical secondary panels (118, 119), not fixed to the first blank, in the approximate form of a quadrant, each terminating away from said fifth fold line in a tooth (120) of height approximately equal to d, and in that said first principal leaf (2) is cut opposite along its first (5) and (9) fifth fold lines.

13. Set of blanks according to claim 1 characterized in that the second blank comprises a fixing tab connected to the adjacent panel by a third fold line and extending along only part of the corresponding adjacent panel, opposite a part of, or displaced from, the fixing tab of the first blank.

14. Set (126, 127) of blanks according to claim 1 characterized in that the second blank comprises a fixing tab (129) connected to the adjacent panel by a third fold line and situated at the opposite end from the fixing tab (128) of the series of leaves of the first blank, outside of said first blank.

15. Set (140, 141) of blanks according to claim 1 characterized in that the second blank comprises a fixing tab (143) that is connected to the adjacent panel by a third fold line, is situated at the same end as and opposite the fixing tab (142) of the series of leaves of the first blank, and is of greater width.

16. Set of blanks according to claim 1, characterized in that the first blank has eight leaves, namely four principal leaves separated from each other by four intermediate leaves designed to form cut-off corners of the box.

17. Packaging box (1', 29, 34, 42, 47, 57, 60, 62, 70, 77, 90, 93, 121, 125) of polygonal section, formed from at least two blanks made from a material in the form of sheets of board or corrugated board, namely a first blank (2, 48, 59, 81, 126, 140) comprising a series of at least four principal leaves (4, 85, 86, 87, 86') ending in a fixing tab (15, 15", 61), said principal leaves and said tab being connected together via first fold lines (5) parallel to each other, directly or via secondary leaves, said series of leaves forming a ring of walls for the box and being connected on one side to a first series (6) of flaps by second fold lines (7) perpendicular to said first fold lines, said series of flaps forming the base of said box, and a second blank (3, 24, 33, 38, 38', 44, 49, 53, 63, 73, 79, 92, 111, 127, 141) comprising at least two panels (10, 11, 12, 13; 25, 26; 39, 40, 41; 45, 46, 47; 49; 55, 56; 64, 65, 66, 67, 68; 74, 75, 76; 94, 96, 97; 112, 114, 116, 117, 118, 119) connected together by a third fold line, namely a first panel and one or more second panels, characterized in that the first panel is fixed and/or centered on the first blank, the second blank overlapping at least one fold line of the first blank, and in that said second panel or at least one of said second panels is fixed to said first blank by means (83, 83', 84, 84', 88, 89) arranged so as to permit relative movement of said second panel or panels with respect to the first blank when the box is being formed, said box being formed by a rolling up of the prejoined blanks around a volume of defined dimensions, the third fold line or lines of the second blank being superimposed on the corresponding fold lines of the first blank.

18. Packaging box according to claim 17, characterized in that the means arranged so as to permit relative movement comprise a precut portion in said second panel or in the leaf opposite, and a hole that continues and is complementary in shape with said precut portion which is fixed nondetachably to the leaf of the first blank or to the second panel opposite it, in order to enable the extra thicknesses to be compensated for by the sliding of said portion in the plane and into said hole during rolling up.

19. Packaging box according to claim 17, characterized in that the first and second blanks are fixed to each other by cold glue with progressive tack.

20. Box according to claim 17 characterized in that the first and second blanks are fixed to each other purely by precut detachable portions.

21. Packaging box (1', 29, 34, 42, 47, 57, 60, 62, 70, 90, 93, 121, 125) according to claim 17 characterized in that the panels of the second blank are opposite the leaves of the first blank.

22. Box (42, 51, 70, 77) according to claim 17 characterized in that it comprises two second blanks.

23. Box (90) according to claim 17 characterized in that the second blank possesses a series of flaps connected to the panels by fourth fold lines perpendicular to the third fold lines.

24. Box according to claim 17 characterized in that the first blank is provided with a second series of flaps situated on the other side of the principal leaves from the first series of flaps, and connected to said leaves by fifth fold lines, to form the lid of the box.

25. Box according to claim 17 characterized in that at least one panel of the second blank is opposite a flap.

26. Box (93) according to claim 25, characterized in that the second blank comprises a series of at least three panels in which one edge is adjacent to the upper edge of at least three adjacent walls of the box, the first blank comprising a pivoting lid portion opposite it, which fits partly around said adjacent edge.

27. Box (121) according to claim 25, characterized in that the second blank comprises a portion that pivots out, at the upper end of one wall of the box, to form a spout (122).

28. Box according to claim 17 characterized in that the second blank comprises a rectangular fixing tab connected to the adjacent panel by a third fold line and situated at the opposite end from the fixing tab of the series of leaves of the first blank.

29. Box according to claim 17 characterized in that the second blank comprises a fixing tab that is connected to the adjacent panel, is situated at the same end as and opposite the fixing tab of the series of leaves of the first blank, and is wider than the tab of the second blank.

30. Box according to claim 17 characterized in that the first blank has eight leaves, namely four principal leaves separated from each other by intermediate leaves forming the cut-off corners of the box.

31. Process for constructing a polygonal-sectional packaging box from at least two blanks made of a material in the form of sheets of board or corrugated board, namely a first blank comprising a series of at least four principal leaves ending in a fixing tab and connected together by first fold lines parallel to each other, said series of leaves forming a ring of walls for the box and being connected on one side to a first series of flaps by second fold lines perpendicular to said first fold lines, said series of folds forming the base of said box, and a second blank comprising at least two panels connected together by a third fold line, namely a first panel and one or more second panels, said second blank forming a reinforcement for said box, characterized in that the flat second blank is at least partly fixed to the flat first blank, and the box is formed by a simultaneous rolling up of the blanks around a volume of defined dimensions, the first panel being held in position with respect to the first blank by causing the second panel or panels to slide with respect to the first blank during the rolling up.

32. Process according to claim 30, characterized in that when positioning the second blank on the first blank, the third fold line or lines of the second blank are displaced from the fold lines of the first blank to enable the extra thicknesses to be compensated for, and at least one second panel is fixed to the first blank by connection means permitting relative movement of said second panel or panels with respect to the first blank.

33. Process according to claim 32, characterized in that said second panel or panels are glued to the first blank with cold glue with progressive tack.

34. Process according to claim 31, characterized in that said second panel or panels of the second blank are fixed to the first blank via at least one portion of panel or of leaf that is precut in either said second panel or said opposing leaf, said portion being detachable from said second panel or leaf and extended in said second panel or leaf by a hole and in that said portion is detached and slid into said hole when the blanks are rolled around the volume of defined dimensions.

35. Process according to claim 31 characterized in that, with each blank comprising a fixing tab situated externally and at the opposite end of the series of leaves or panels from the other blank, after said tabs have been glued, the tab of the second blank is folded onto the volume of defined dimensions at the junction between the walls of the box, and the opposing leaf of the first blank is then laid on said tab, the tab of the first blank is prefolded about the third fold line of the tab of the second blank and said tab of the first blank is laid on the opposing wall of the box.

36. Process according to claim 31 characterized in that, with each blank comprising a fixing tab situated at the same end of the series of respective leaves or panels and opposite each other, at the junction between the walls of the box, the fixing tab of the series of leaves of the first blank being wider than the tab of the second blank, and therefore projecting out beyond the latter, the two preglued tabs are prefolded around the volume of defined dimensions, after which first the tab of the first blank and then the tab of the second blank are laid on the opposing wall or walls of the box.

37. Machine (150, 170, 160) for constructing a polygonal-section packaging box from at least two blanks made of a material in the form of sheets of board or corrugated board, namely a first blank comprising a series of at least four principal leaves ending in a fixing tab, connected together by first fold lines parallel to each other, said series of leaves forming a ring of walls for the box and being connected on one side to a first series of flaps by second fold lines perpendicular to said first fold lines, said series of flaps forming the base of said box, a second blank comprising at least two panels connected together by a third fold line, namely a first panel and one or more second panels, said second blank forming a reinforcement for said box, characterized in that it comprises means (157, 158, 165) for positioning the second blank on the first blank, the third fold line or lines of the second blank being positioned with respect to the first or second fold lines of the first blank so as to permit said blanks to be rolled around said volume of defined dimensions with compensation for the extra thicknesses of the sheets of board, means (156, 167) for fixing at least one second panel to the first blank with glue to permit relative movement of said second panel or panels with respect to the first blank, the second blank overlapping at least one fold line of the first blank, and means (161) for forming the box by rolling the connected blanks around a volume of defined dimensions, permitting the second panel or panels to slide with respect to the first blank.

38. Machine according to claim 37, characterized in that the volume of defined dimensions is a polygonal-section mandrel (161).

39. Machine according to claim 37, characterized in that it is arranged so that the volume of defined dimensions is formed by the products to be packed.

40. Machine according to claim 37, characterized in that it comprises means for fixing the second panels of the second blank to said first blank with cold glue with adhesive tack.

41. Machine according to claim 37 characterized in that, with each blank comprising a fixing tab situated externally and at the opposite end of the series of leaves or panels from the other blank, it comprises means for folding the tab of the second blank onto the volume of defined dimensions, at the junction between the walls of the box, means for laying the opposing leaves of the first and second blanks on said tab, means for prefolding the tab of the first blank along the third fold line of the tab of the second blank and definitively laying said tab of the first blank on the opposing wall of the box.

42. Machine according to claim 37 characterized in that, with each blank comprising a fixing tab situated at the same end of the series of respective leaves or panels, opposite each other, at the junction between the walls of the box, the fixing tab of the first blank being wider than the tab of the second blank so that it projects beyond the latter, said machine comprises means (144) for prefolding the two tabs together around the volume, means (146) for applying the tab of the first blank, and means (147) for applying the tab of the second blank, in such a way that there is successive application of the two overlapping preglued tabs on the opposing wall or walls of the box.

* * * * *